United States Patent [19]

Eftefield

[11] B 3,981,150

[45] Sept. 21, 1976

[54] DUAL HYDRAULIC MOTOR DRIVE SYSTEM

[75] Inventor: Larry G. Eftefield, Joliet, Ill.

[73] Assignee: Caterpillar Tractor Co., Peoria, Ill.

[22] Filed: Dec. 23, 1974

[21] Appl. No.: 535,386

[44] Published under the second Trial Voluntary Protest Program on January 13, 1976 as document No. B 535,386.

[52] U.S. Cl. ..... 60/425; 60/430; 60/468; 60/486; 91/412

[51] Int. Cl.[2] ..... F15B 11/16

[58] Field of Search ..... 60/421, 422, 425, 426, 60/427, 429, 468, 486, 483; 91/412, 411 R, 411 A; 137/488

[56] References Cited

UNITED STATES PATENTS

| | | | |
|---|---|---|---|
| 2,370,526 | 2/1945 | Doran | 60/425 |
| 2,374,588 | 4/1945 | Doran | 60/425 |
| 2,643,516 | 6/1953 | Carlson | 60/486 X |
| 3,129,781 | 4/1964 | Stein | 60/426 X |
| R27,334 | 4/1972 | Zimmerman | 60/486 X |

*Primary Examiner*—Edgar W. Geoghegan
*Attorney, Agent, or Firm*—Oscar G. Pence

[57] ABSTRACT

A dual hydraulic motor drive system is provided for powering a material loading elevator of a self-loading scraper vehicle. Such drive system includes a pair of hydraulic motors which are disposed in a fluid circuit having a blocker valve movable between a first position to direct fluid pressure to just one of the motors to provide high speed, low torque operation of the elevator and a second position to direct fluid to both of the motors to provide low speed, high torque operation of such elevator. Actuator means responsive to loading resistance affecting the elevator being effective to automatically position the blocker valve in its first position during normal loading conditions and to shift it to its second position when severe loading conditions are encountered so as to prevent stalling of the elevator.

7 Claims, 2 Drawing Figures

DUAL HYDRAULIC MOTOR DRIVE SYSTEM

BACKGROUND OF THE INVENTION

This invention relates to hydraulic drive systems for powering the elevator of self-loading scrapers.

Such self-loading scrapers are used to load a wide variety of materials which have different loading characteristics affecting the speed and power requirements of the elevator. For example, some materials, such as sand or other loose materials, are easy to load due to their relatively low loading resistance and are best loaded at relatively high elevator speeds. Extremely strong undisturbed soils and the like are much more difficult to load and place a much greater loading resistance on the elevator. Frequently, such loading resistance is sufficiently great to cause the elevator to stall. Such stalling is highly undesirable because the elevator can not normally be restarted in the middle of a cut due to the loading resistance and the high inertia forces which must be overcome. This, of course, results in a large amount of lost productivity due to the time wasted in transporting and discharging of partial loads.

As it is also more difficult to move the scraper's cutting edge through such extremely cohesive soils, more of the available power of the scraper's engine must be applied to the tractor wheels in order to maintain the forward movement of the vehicle. Consequently, it is undesirable to draw the increase in torque needed to keep the elevator moving from the engine so that the engine is not unduly overloaded and forced into a lugging condition.

Another problem is that severe loading conditions frequently occur quite abruptly in operation due to changes in soil consistency and sudden changes in the depth of cut being made by the scraper due to varying terrain conditions. Consequently, unless immediate adjustments are made, the elevator will stall.

OBJECTS OF THE INVENTION

Accordingly, it is an object of the present invention to provide a dual hydraulic motor drive system for powering a material loading elevator of a self-loading scraper which utilizes one of its motors under normal loading conditions to provide high speed, low torque operation of the elevator and which automatically actuates the other motor when severe loading conditions are encountered so as to provide an increase in torque output of the drive system to prevent stalling of the elevator under such severe conditions.

Another object of this invention is to provide a drive system whose increase in torque output to the elevator is effective in reducing the drive system's horsepower demand on the vehicle's engine so that more of the available power of the engine can be utilized to maintain the movement of the vehicle during such severe loading conditions.

Another object of this invention is to provide such drive system which is capable of responding quickly to any increase in loading resistance so as to provide the necessary torque increase in time to prevent the stalling of the elevator and is further capable of retaining the drive system in its high torque output setting until the severe loading condition has essentially diminished so that stability of operation is obtained.

Other objects and advantages of the present invention will become more readily apparent upon reference to the accompanying drawing and following description.

DESCRIPTION OF THE PREFERRED EMBODIMENT

Figure 1:
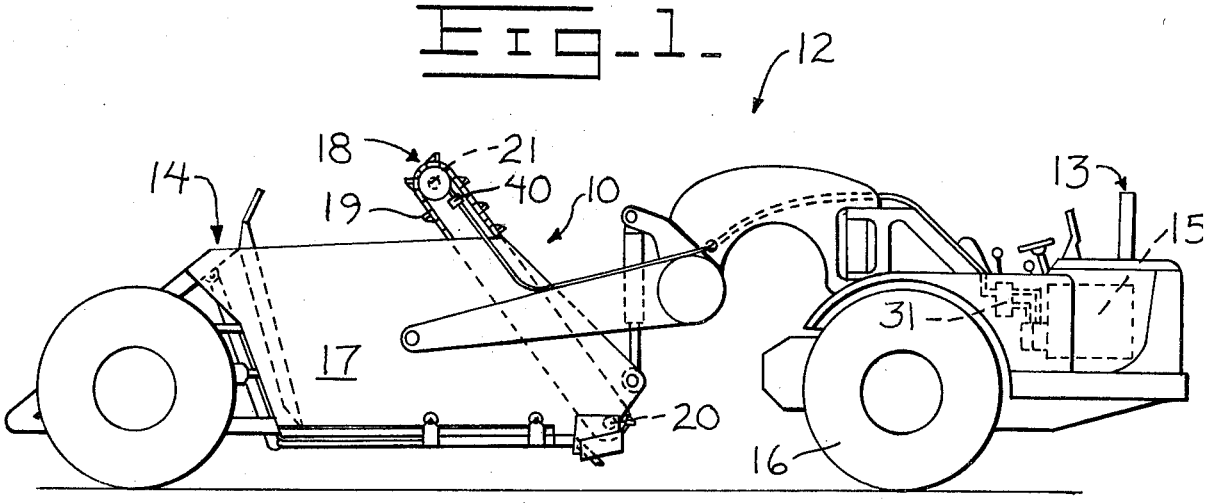
FIG. 1 is a side elevational view of a self-loading scraper having a material loading elevator which is powered by a dual motor drive system embodying the principles of the present invention.

Referring more particularly to the drawing, a dual hydraulic motor drive system embodying the principles of the present invention is generally indicated at 10 in association with a self-loading scraper vehicle 12 including a tractor portion 13 and a scraper portion 14. The tractor portion is powered by a prime mover or internal combustion engine 15. The engine is adapted for driving a pair of ground engaging wheels, one of which is shown at 16, through a conventional drive train, not shown. The scraper portion 14 includes a scraper bowl 17 having a material loading elevator 18 mounted within its forward open end in the usual manner. The elevator includes an endless conveyor 19 mounted for rotation about a lower idler shaft 20 and an upper drive shaft 21. Such conveyor is rotatably driven by the dual motor drive system of the present invention.

Figure 2:
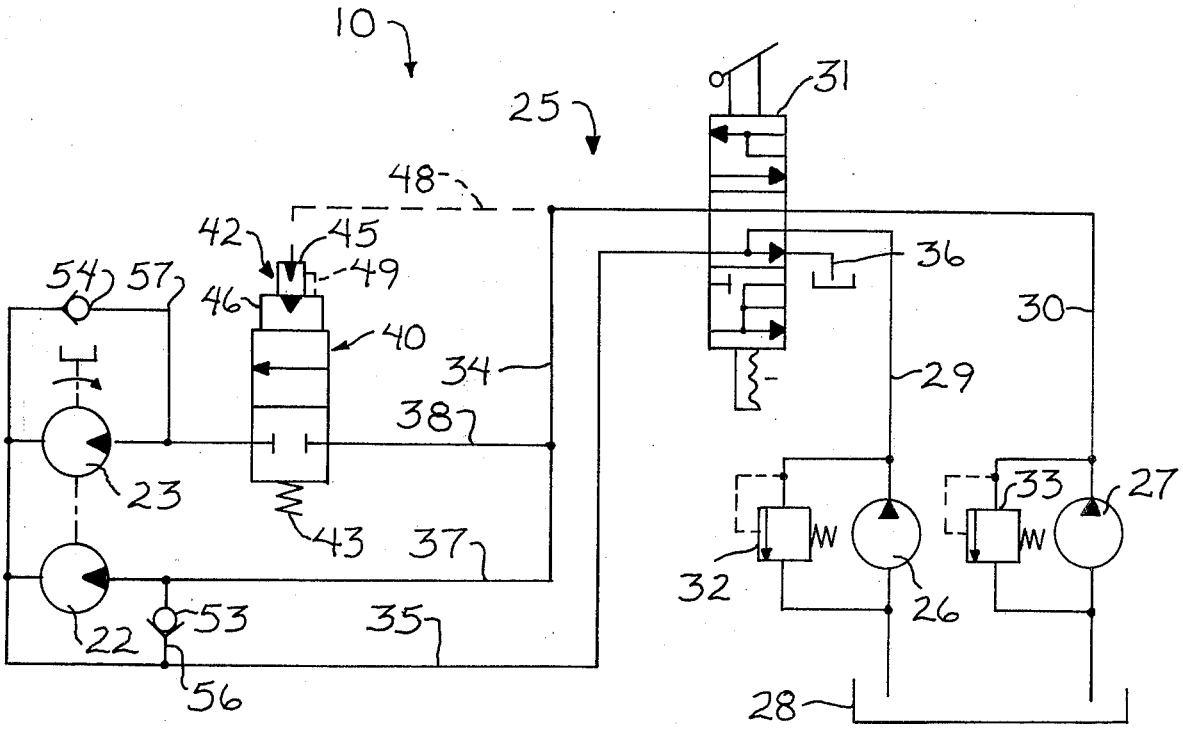
FIG. 2 is a schematic view illustrating the preferred construction of such drive system.

As best shown in FIG. 2, the dual motor hydraulic drive system 10 includes first and second fixed displacement-type hydraulic motors 22 and 23 which are drivingly coupled to the conveyor's drive shaft 21. It is preferred that such motors be of essentially the same size.

The motors 22 and 23 are disposed in a fluid circuit 25 including a pair of fixed displacement hydraulic pumps 26 and 27. Such pumps are adapted to draw hydraulic fluid from a fluid reservoir 28. A pair of conduits 29 and 30 are provided for individually communicating fluid pressure from each of the pumps to a manually actuatable control valve 31. A pair of relief valves 32 and 33 are provided in conduits 29 and 30, respectively, for relieving undue pressures in the fluid circuit in a normal manner.

A main pressure conduit 34 is also connected to the control valve 31 for directing the fluid pressure from the pumps to the motors 22 and 23 in a manner hereinafter described. A return conduit 35 also interconnects the motors to the control valve for returning fluid to the valve which is then exhausted to the reservoir 28 through a drain conduit 36. The control valve 31 is selectively movable to any of three positions, with an upper or first operative position being adapted to communicate fluid from both of the pumps to the main conduit 34. A middle or second operative position is adapted to communicate fluid only from the pump 27 to the conduit 34. The lower position provides a neutral position which blocks all of the fluid to the conduit 34.

The main pressure conduit is connected to a pair of branch conduits 37 and 38 which individually communicate fluid pressure to their respective motors 22 and 23. As is readily shown by the circuit, conduit 37 is connected directly to its motor 22, whereas conduit 38 has a two position blocker valve 40 disposed therein.

The blocker valve 40 is movable between a first position, in which it is shown, and a second position. The first position is adapted to block fluid to second motor 23 so that all of the fluid from the control valve 31 is directed to the first motor 22. The second position permits fluid flow to the second motor 23 so that the available fluid from the control valve is divided between the two motors.

Actuator means 42 are operatively connected to the blocker valve 40 to automatically shift the blocker valve between its two positions. Such actuator means includes a biasing spring 43 which is provided with a predetermined force and positioned at the lower end of the blocker valve for urging the valve toward its first position. The actuator means also include first and second pilot actuators 45 and 46, respectively, which are positioned in tandem at the upper end of the blocker valve. A first pilot conduit 48 is provided to connect the first pilot actuator to the main pressure conduit 34. A second pilot conduit 49 is provided to serially connect the first pilot actuator 45 to the second pilot actuator 46.

The first pilot actuator 45 is provided with a predetermined fluid surface working area which only provides a force sufficient to overcome that of the spring 43 when a predetermined high fluid pressure exists in the fluid circuit 25. In the present instance, such high fluid pressure is chosen to be approximately equal the maximum pressure allowed in the circuit by the relief valves 32 and 33 so as to shift the blocker valve when stalling of the elevator is apparent.

Whenever such high fluid pressure is reached, the first pilot actuator will shift the blocker valve to its second position which energizes the second motor 23. The additional torque provided by the second motor causes a reduction in the fluid pressure in the circuit 25. To prevent the blocker valve from returning to its first position due to the imbalance created by such pressure reduction, the first pilot actuator is adapted to communicate fluid pressure in the circuit to the second pilot actuator 46 through the pilot conduit 49 when the blocker valve is in its second position. The second pilot actuator is adapted to provide a sufficient amount of additional fluid surface working area to keep the blocker valve in its second position. Such additional working area is also preferably sufficient to retain the blocker valve in its second position until loading resistance on the elevator reduces to a point where the additional torque of the second motor is no longer deemed necessary to drive the elevator.

The fluid circuit also includes a pair of makeup valves 53 and 54. Such valves are individually disposed in a pair of conduits 56 and 57 which interconnect each of the conduits 37 and 38, respectively, with the return conduit 35 for providing makeup fluid to the motors in a normal manner. The makeup valve 54 for motor 23 is particularly useful to allow circulation of exhaust fluid therethrough when not being supplied by fluid pressure from the circuit during the normal loading conditions mentioned earlier. This prevents the rotation of such motor without fluid.

OPERATION

While the operation of the present invention is believed clearly apparent from the foregoing description, further amplification will be made in the following brief summary of such operation. In such operation, the scraper's engine 15 is effective in driving the hydraulic pumps 26 and 27 to cause the flow of fluid to the control valve 31. Selective manipulation of the control valve to its first position provides for the high speed operation of the elevator, whereas actuation of the valve to its second position provides slow speed operation of the elevator.

During use of the elevator to load material into the scraper bowl, the amount of fluid pressure in the fluid circuit 25 will be directly proportional to the amount of loading resistance affecting the elevator as will become more readily apparent, this phenomena is advantageously utilized in the present invention to determine the positioning of the blocker valve. Consequently, whenever the loading resistance is low enough so as not to cause the fluid in the circuit to reach the predetermined high fluid pressure, only the first motor 22 will be operative. This affords the high speed-low torque operation of the elevator particularly useful in loading light materials.

Whenever loading resistance becomes severe enough to cause the fluid pressure in the circuit to reach the predetermined high level, the first pilot actuator 45 automatically shifts the blocker valve 40 to its second position. This occurs almost instantaneously so that the second motor is actuated quickly enough to prevent stalling of the elevator. The dividing of the fluid flow between the two motors causes a reduction in the speed of the elevator and an accompanying increase in driving torque thereto because of the accumulative working areas of the two motors.

It will also be appreciated that for a given loading resistance, the increase in torque afforded by the second motor will be accompanied by a concurrent reduction in fluid pressure in the circuit. This pressure reduction beneficially reduces the power demand of the pumps on the engine 15 so that more of the engine's horsepower can be more effectively utilized in moving the scraper's cutting edge through the soil which also normally becomes more difficult when severe loading conditions are encountered on the elevator.

The use of the second pilot actuator 46 serves two functions. First, it is adapted to insure that the pressure drop resulting from the actuation of the second motor does not cause the blocker valve 40 to return to its first position. Second, it also serves to delay the return of the blocker valve to its first position until the severe loading condition has sufficiently diminished to a point where the second motor is no longer needed.

Thus, it is apparent from the foregoing that the objects of the present invention have been fully satisfied by the construction of the present dual hydraulic motor drive system by being capable of quickly and automatically increasing the driving torque to an elevator when severe loading conditions are encountered by such elevator in order to avert its stalling. The construction of such drive system also provides a reduction in the drive system's demand on the scraper's engine so that a greater portion of the engine's power can be utilized to perform other work functions during such severe loading conditions. Its particular construction also enables the drive system to be retained in its high torque setting until the severe loading condition has essentially dissipated to reduce undue shifting between its high and low torque settings to provide greater operational stability.

While the present invention has been described and shown with particular reference to the preferred embodiment, it will be apparent that variations might be possible that would fall within the scope of the present invention, which is not intended to be limited except as defined in the following claims.

The embodiments of the invention in which an exclusive property or privelege is claimed are defined as follows:

1. A dual hydraulic motor drive system for driving a material loading elevator of a self-loading scraper vehicle powered by a prime mover, comprising:

a source of fluid pressure including at least one hydraulic pump operatively driven by said prime mover;

first and second hydraulic motors drivingly connected to said elevator;

a fluid circuit for selectively communicating said source of fluid pressure to said motors including a manually actuatable control valve, a blocker valve, and a main pressure conduit connected to said control valve and having a pair of branch conduits individually connected to said first and second motors with said blocker valve being disposed in said branch conduit to said second motor, said blocker valve being movable between a first position for blocking fluid to said second motor so that said elevator is operatively driven solely by said first motor at a high speed, low torque setting and a second position for directing fluid to both of said motors to operatively drive said elevator at a low speed, high torque setting; and actuator means responsive to loading resistance on the elevator and operatively connected to said blocker valve automatically to shift said blocker valve from its first position to its second position when such loading resistance increases above a predetermined high level so that the increased torque output of the drive system provided through the operation of both of said motors is effective in preventing stalling of said elevator due to said high level of loading resistance and subsequently to return said blocker valve to its first position only when the loading resistance returns to a level substantially lower than said high level so as to enhance operator stability, said actuator means including a biasing spring mounted at one end of said blocker valve and having a predetermined force for urging said blocker valve toward its first position, first and second pilot actuators mounted in tandem at the other end of said blocker valve, a first pilot conduit connecting said first pilot actuator to said main pressure conduit, a second pilot conduit adapted to serially connect said first pilot actuator to said second pilot actuator when said blocker valve is disposed in its second position, said first pilot actuator being provided with a predetermined fluid surface working area to provide a sufficient force to overcome the predetermined force of said biasing spring when a predetermined high fluid pressure exists in said main pressure conduit to shift said blocker valve to its second position and said second pilot actuator being adapted to provide a sufficient amount of additional fluid surface working area so as to retain said blocker valve in its second position until fluid pressure in said main pressure conduit reduces to a level substantially lower than said predetermined high fluid pressure.

2. The dual hydraulic motor drive system of claim 1 wherein said source of fluid pressure includes;

a fluid reservoir;

another hydraulic pump operatively driven by said prime mover, said pumps being adapted to draw fluid from said reservoir; and a pair of conduits individually connecting each of said pumps to said control valve, said control valve having a first position for directing fluid pressure from both of said pumps to said main pressure conduit, a second position for directing fluid pressure from only one of said pumps to the main pressure conduit, and a third position for blocking all fluid thereto so as to provide manually controllable on/off, two speed operation of the drive system.

3. The dual hydraulic motor drive system of claim 2 wherein said motors each have an inlet and an outlet; and said fluid circuit includes fluid makeup means connecting the outlets of said motors with their respective inlets to permit communication of fluid exhausted from said outlets to said inlets to provide any necessary makeup fluid to said motors during operation, but prevent the loss of fluid in the reverse direction.

4. A dual hydraulic motor drive system for driving a material loading elevator for a self-loading scraper vehicle, comprising:

a source of fluid pressure;

first and second hydraulic motors drivingly connected to said elevator;

a fluid circuit for selectively communicating said source of fluid pressure to said motors including a blocker valve movable between a first position for blocking fluid to one of said motors so that said elevator is operatively driven solely by the other of said motors at a high speed, low torque setting and a second position for directing fluid to both of said motors to operatively drive said motor at a low speed, high torque setting; and means for automatically shifting said blocker valve between its first and second positions including a pair of actuators for shifting said blocker valve towards its second position, with one of said actuators being continually responsive to loading resistance on the elevator to shift said blocker valve to its second position when the loading resistance increases to a predetermined relatively high level, and the other of said actuators being responsive to loading resistance only when said blocker valve is in its second position to assist said one actuator so that the blocker valve is held in its second position until such time that the loading resistance subsides to a level substantially lower than said high level.

5. The drive system of claim 4 wherein said means for automatically shifting said blocker valve further includes;

biasing means mounted at one end of said blocker valve for urging said valve towards said first position; and said pair of actuators are pilot actuators mounted in tandem at the other end of said blocker valve for opposing said biasing means, one of said pilot actuators being connected to said fluid circuit for operation in response to fluid pressure therein to effect the shifting of the blocker valve to its second position at a predetermined relatively high fluid pressure, and the other pilot actuator being connected in series with said one pilot actuator for sequential operation therewith to effect the holding of said blocker valve in its second position until a fluid pressure substantially lower than said high fluid pressure exists in said circuit to alleviate undue valve shuttling so as to enhance operational stability.

6. The dual hydraulic motor drive system of claim 5 wherein:

said source of fluid pressure includes a pair of hydraulic pumps; and said fluid circuit includes a manually actuatable control valve, a pair of conduits individually connecting said pumps to said control valve, and a main pressure conduit connected to said control valve and having a pair of branch conduits individually connecting said main conduit to said first and second motors with said blocker valve being disposed within said branch conduit to said second motor, said control valve having a first position for directing fluid pressure from both of said pumps to said main pressure conduit, a second position for directing fluid pressure from only one of said pumps to said main pressure conduit and a third position for blocking all fluid thereto so as to provide manually controllable on-off, two-speed operation of the drive system.

7. The dual hydraulic motor drive system of claim 6 wherein;

said motors each have an inlet and an outlet; and said fluid circuit includes fluid make up means connecting the outlets of said motors with their respective inlets to permit communication of fluid exhausted from said outlets to said inlets to provide any necessary make up fluid to said motors during operation, but prevent the loss of fluid in the reverse direction.

* * * * *